US006965217B2

(12) United States Patent
Dohnal et al.

(10) Patent No.: US 6,965,217 B2
(45) Date of Patent: Nov. 15, 2005

(54) TAP CHANGING ASSEMBLY FOR POWER TRANSFORMER

(75) Inventors: Dieter Dohnal, Lappersdorf (DE); Karsten Viereck, Regenstauf (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 10/790,326

(22) Filed: Feb. 27, 2004

(65) Prior Publication Data

US 2004/0196010 A1 Oct. 7, 2004

(30) Foreign Application Priority Data

Apr. 3, 2003 (DE) ..... 103 15 205

(51) Int. Cl.[7] ..... G05F 1/153
(52) U.S. Cl. ..... 323/257
(58) Field of Search ..... 323/257, 258, 323/256

(56) References Cited

U.S. PATENT DOCUMENTS

| | | | | |
|---|---|---|---|---|
| 4,434,388 A | * | 2/1984 | Carver et al. | 315/307 |
| 6,020,821 A | | 2/2000 | Bauerschmidt et al. | |
| 6,084,503 A | | 7/2000 | Ruile | |

FOREIGN PATENT DOCUMENTS

| | | |
|---|---|---|
| DE | 40 09 038 | 9/1991 |
| DE | 0 716 489 | 6/1996 |
| DE | 195 46 215 | 4/1997 |

* cited by examiner

*Primary Examiner*—Shawn Riley
(74) *Attorney, Agent, or Firm*—Herbert Dubno

(57) ABSTRACT

A tap changing assembly for power transformers having vacuum interrupters each of which is associated with a radio interrogated surface wave sensor capable of detecting whether the respective vacuum interrupter opens circuit in a timely manner. The sensors are interrogated by an interrogating unit transmitting high-frequency signals to the sensors and associated with a monitoring circuit responsive to signals received by the interrogating unit for signalling the status of the vacuum interrupter.

5 Claims, 1 Drawing Sheet

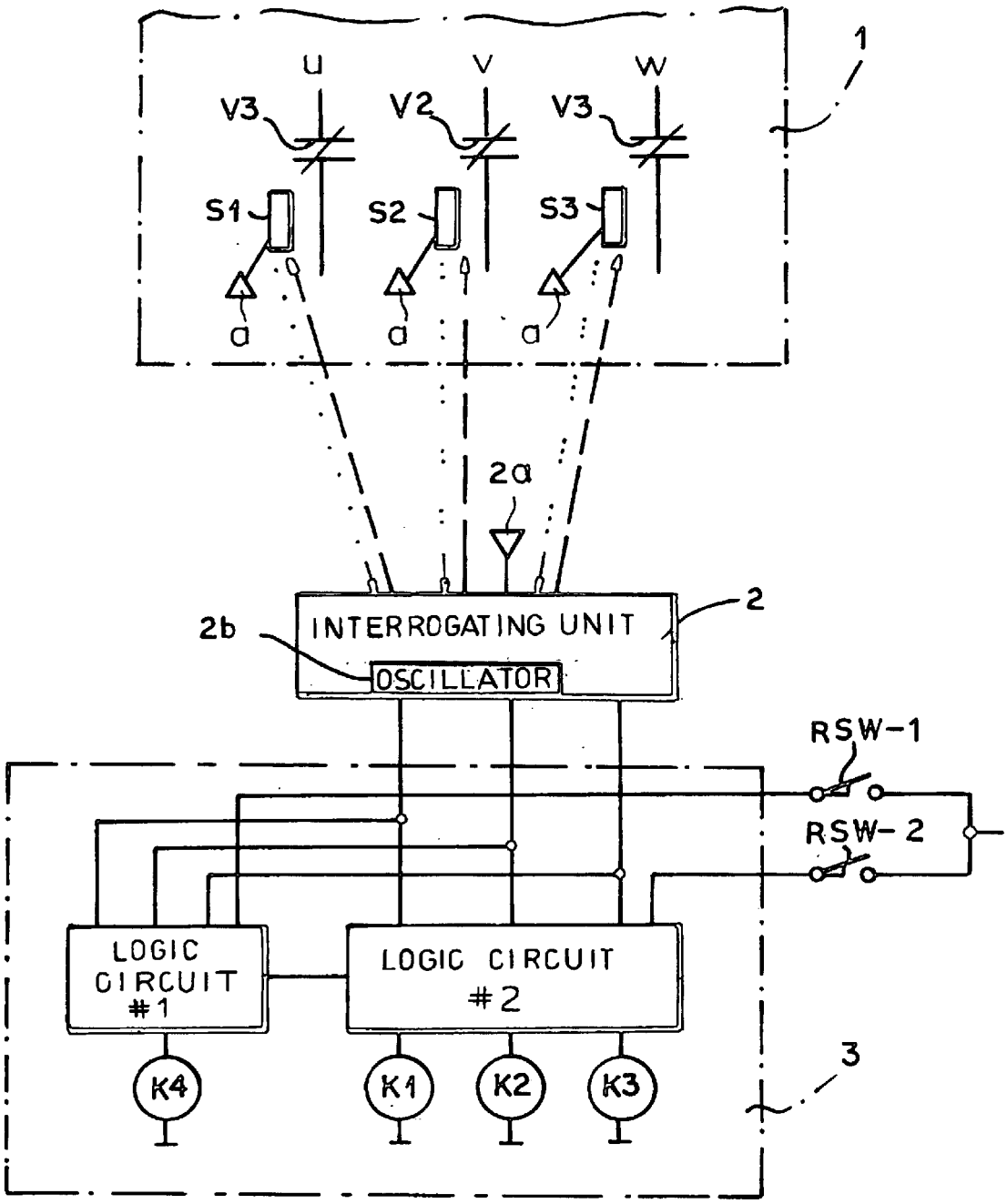
1
u
v
w
V3
V2
V3
S1
S2
S3
a
a
a
2a
2
2b
INTERROGATING UNIT
OSCILLATOR
RSW-1
RSW-2
LOGIC CIRCUIT #1
LOGIC CIRCUIT #2
K4
K1
K2
K3
3

TAP CHANGING ASSEMBLY FOR POWER TRANSFORMER

FIELD OF THE INVENTION

Our present invention relates to a tap-changing assembly for power transformers and, more particularly, a monitoring system for a tap changer in which the tap changer is capable of tap changing under load and for each phase has at least one vacuum interrupter or vacuum switching tube.

BACKGROUND OF THE INVENTION

A tap changer capable of tap changing under load is described, for example, in DE 40 09 038 A1 and the corresponding U.S. Pat. No. 5,128,605. In such tap changers, a vacuum interrupter for each phase is opened before a mechanical switch is shifted to prevent significant arcing at the mechanical switch.

In such tap changers it is a common practice to monitor mechanical contacts and in the past this has often proved to be a problem since the mechanical contacts are bathed in oil. As a consequence, vacuum interrupters have been provided and it is of course desirable to monitor the operation of the vacuum interrupters since, should a vacuum interrupter not open in a timely fashion and thus relieve the mechanical switching elements for the particular tap from the current, a high-power electric arc can form which can result in a burning away of the mechanical contacts. Frequent switching under arcing conditions can result in major damage to the tap changer or can create critical operating conditions which must be avoided.

The monitoring system of DE 40 09 038 A1 and U.S. Pat. No. 5,128,605 is described for a tap changer of the reactor switching type. In this known monitoring system, in the current feed of each vacuum interrupter there is a respective current converter which supplies an output voltage to a transmitter diode (LED) which is associated with a light waveguide (light-transmitting cable or fiber) or optical fiber, which delivers that optical signal to a respective receiver. The current converter is thus capable of signalling whether or not the respective branch which is monitored has a current flow. The monitoring system is thus capable of determining whether, at a critical point in time determined by the actuation of the mechanical switch, the current flow has been interrupted. It is important, for example, to know the status of the vacuum interrupter and to be certain that the current flow has been interrupted before the mechanical switch begins to shift. If at this latter point in time a current is still present in the vacuum interrupter for the given phase, a defect can be signaled for that phase, indicating that the vacuum interrupter has not opened.

This monitoring system has been found to be effective and has been used for years and, has been available from Rheinhausen Manufacturing Inc. as its type "RMV" load-type tap changer. That system, however, has a drawback in that the status information must be supplied by light waveguides which extend out of the oil-filled interior of the tap changer. The waveguides can alter the dielectric breakdown voltage within the tap changer and also require special seals.

OBJECTS OF THE INVENTION

It is, therefore, the principal object of the present invention to improve upon the monitoring system previously described and eliminate the aforementioned drawbacks thereof by providing an improved tap changing assembly wherein, especially, the need for special seals is eliminated and, in addition, the change in the breakdown voltage within the tap changer oil bath is likewise obviated.

Another object of this invention is to provide an improved tap-changing assembly whereby the monitoring of the vacuum interrupters can be effected entirely in a contactless manner from the exterior.

SUMMARY OF THE INVENTION

These objects are achieved, in accordance with the invention in a tap-changing assembly for power transformers which comprises:

a tap changer having at least one vacuum interrupter open-circuiting upon a tap change and conducting an electric current in an absence of a tap change; and a monitoring device for monitoring timely operation of the vacuum interrupter, the monitoring device comprising:

at least one interrogatable surface wave sensor proximal to a conductor in circuit with the vacuum interrupter, an interrogating unit spaced from the vacuum interrupter and transmitting a high-frequency signal to and receiving a high-frequency signal from the sensor, and a monitoring circuit electrically connected to the interrogating unit and responsive to a signal received by the interrogating unit from the sensor for signalling a status of the vacuum interrupter.

The tap changer is usually configured for a polyphase system and each phase is provided with at least one of such vacuum interrupters and each vacuum interrupter is provided with a respective one of the surface wave sensors.

According to a feature of the invention the vacuum interrupters and the surface wave sensors are located in the oil-filled compartment of the tap changer while the interrogating unit and the monitoring circuit are located externally thereof. The surface wave sensor is preferably a radio interrogated surface wave sensor (U.S. Pat. No. 6,084,053) disposed in the tap-changer housing containing the interrupter.

The invention makes use of an AOW (Acoustic Surface Wave) sensor or a SAW (Surface Acoustic Wave) sensor of the radio interrogatable type. Up to now such sensors have not been employed, to our knowledge, in tap changers. Such surface wave sensors usually have a $LiNbO_3$ substrate which is received in a metallic or ceramic housing and can be constructed as are integrated circuits. The sensors can effectively be read in a wireless manner by radio. The losses with surface wave sensors are extremely small and the sensor need not have a separate energy supply for signal processing. For radio interrogation, apart from the surface wave sensor, an interrogating unit is required. This interrogating unit is generally equipped with an oscillator capable of generating high frequency pulses in a frequency range of 100 MHz to 3 GHz and to transmit that radio signal via an antenna. The sensor itself can have an antenna built into it and can have integrated therein an interdigital converter as well as, in many cases, a multiplicity of reflectors. The interdigitator converter is usually of a comb configuration and is excited by the received high frequency pulse and can generate by the piezoelectric effect an acoustic surface wave. The acoustic surface wave is partly reflected at the reflectors so that it is returned to the interdigital converter. From the latter it is converted back to a pulsed radio signal and via the antenna of the surface wave sensor is transmitted wirelessly back to the interrogator unit.

The pulse sequence which is outputted by the surface wave sensor is received by the interrogating unit and contains information from the sensor in the form of a specific bit pattern which can identify the sensor and provide information as to the state of the conductor leading to the interrupter. A single interrogating circuit can receive information, therefore, from a multiplicity of different surface wave sensors and, more specifically, information as to changes in a relevant physical parameter of the sensor, for example velocity changes in the surface wave spreading from the sensor or a variation in the geometric spacing of the reflectors.

Such a parameter change results in a change in the transmit time of the pulses from the sensor which are detected by the interrogating unit and evaluated by the monitoring circuit (see WO 96/33423, corresponding to U.S. Pat. No. 6,084,503). WO 96/33417 describes how such a surface wave sensor can be used for current amplitude measurements at high voltage electrical devices. The surface wave sensor thus functions as a kind of current converter like a magnetosensitive element which can be coupled with the surface wave structure and is particularly useful for the purposes of the invention.

BRIEF DESCRIPTION OF THE DRAWING

The above and other objects, features and advantages of the invention will become more readily apparent from the following description, reference being made to the sole FIGURE of the accompanying drawing which is a diagram illustrating the invention.

SPECIFIC DESCRIPTION

The drawing shows a tap-changing assembly for power transformers in accordance with the invention which can have an oil vessel 1 of the tap changer in which three vacuum interrupters V1, V2, V3 are provided for each of the three phases U, V, W. The invention is however not limited to such an arrangement and can be used for monitoring any electrical circuit with tap changers having any number of an interrupters per phase. It is intended to determine the status of the vacuum interrupters V1–V3 at certain points in time, especially to determine whether these interrupters have been open circuited in a timely manner. Should this not be the case, i.e. should a vacuum interrupter not have opened in a timely manner, there remains in the corresponding branch a current flow.

To detect this current flow in the region of each vacuum interrupter and particularly adjacent the current feed line thereto, a respective radio interrogated surface wave sensor S1, S2, S3 is provided. These sensors do not require any separate energy supply. Externally of the oil vessel 1 there is an interrogating unit 2 which has an oscillator and an antenna 2*a*. The oscillator has been shown at 2*b* in the drawing. The oscillator transmits high frequency pulses via the antenna 2*a* to the surface wave sensor S1, S2, S3 to be picked up by their antennae a. The sensors S1, S2, S3 generate respective acoustic surface waves which, after being reflected by the reflectors within the respective sensors are transmitted again to the interrogating unit 2. The high frequency signals transmitted by the interrogating unit have been shown in dashed lines. The returned radiation has been shown in dotted lines. The different portions of the dotted lines represent the specific bit patterns which in turn are sensor-specific and enable the interrogating unit 2 and the logic circuitry of the monitoring circuit 3 to identify the specific sensors S1, S2 and S3.

In the event of a failure of one of the vacuum interrupters, i.e. a failure of that interrupter to open the circuit at a corresponding interrogation point in time, a current continues to flow through the corresponding branch and thus influences the electromagnetic field in the region of the sensor and thus effects the surface wave which spreads out therefrom and varies the pulse timing. The altered pulse timing (travel time of the pulses of he sequence) of the corresponding sensor is picked up by the interrogating unit 2 as recognized by the logic circuitry of the monitoring unit 3 which signals that failure, and, of course, prevents the corresponding mechanical switches from effecting the tap change.

To determine the control points or timing for the monitoring circuit, two synchronous contacts or switches RSW-1 or RSW-2 are actuated synchronously with the tap changer and thus establish the critical points in time for the logic circuit #1 and #2. Logic circuit #1 can detect a system failure of the monitoring system while logic circuit #2 detects the failure of a vacuum interrupter at a critical time point. The logic circuits have outputs K1–K3 which signal failure in the corresponding vacuum interrupter when it remains closed at the critical time point and thus each of these outputs signals status of one of the respective vacuum interrupters V1—V3. A further output or signalling unit K4 provides a signal when a system failure occurs.

With the invention light waveguides or other signal transmission elements from the interior of the tap changer to the exterior are no longer required nor can there be a problem with the seals for the oil-containing vessels. The interrogating unit 2 and the monitoring circuitry 3 can be provided outside the oil-containing vessel of the tap changer in the region of the tap-changer motor drive or at some other location.

We claim:

1. A tap-changing assembly for power transformers, comprising:

a tap changer having at least one vacuum interrupter open-circuiting upon a tap change and conducting an electric current in an absence of a tap change; and a monitoring device for monitoring timely operation of said vacuum interrupter, said monitoring device comprising:

at least one interrogatable surface wave sensor proximal to a conductor in circuit with said vacuum interrupter, an interrogating unit spaced from said vacuum interrupter and transmitting a high-frequency signal to and receiving a high-frequency signal from said sensor, and a monitoring circuit electrically connected to said interrogating unit and responsive to a signal received by said interrogating unit from said sensor for signalling a status of said vacuum interrupter.

2. The tap-changing assembly defined in claim 1 wherein the tap changer is configured for a polyphase system and each phase is provided with at least one of said vacuum interrupters and each of said vacuum interrupters is provided with a respective one of said surface wave sensors.

3. The tap-changing assembly defined in claim 2 wherein said vacuum interrupters and surface wave sensors are located in an oil-containing housing of said tap changer and said interrogating unit and monitoring circuit are located in a region of a motor drive for said tap changer.

4. The tap-changing assembly defined in claim 2 wherein said surface wave sensors are radio-interrogated surface wave sensors and said interrogating unit has an oscillator operating in a frequency range of 100 MHz to 3 GHz and an antenna.

5. The tap-changing assembly defined in claim 2, further comprising contacts connected to said monitoring circuit for establishing critical time points for interrogating said sensors.

* * * * *